US008899990B2

(12) United States Patent
Helton et al.

(10) Patent No.: US 8,899,990 B2
(45) Date of Patent: Dec. 2, 2014

(54) DISPLAY MOUNTING SYSTEMS

(75) Inventors: John Helton, Powder Springs, GA (US); Peter W. Hildebrandt, Duluth, GA (US); Michael Boyle, Dacula, GA (US); Douglas MacDonald, Dacula, GA (US); Paul A. Balogh, Dixonville, PA (US); Dale Miller, Snelville, GA (US); Robert Bergman, Lawrenceville, GA (US)

(73) Assignee: Steelcase Inc., Grand Rapids, MI (US)

( * ) Notice: Subject to any disclaimer, the term of this patent is extended or adjusted under 35 U.S.C. 154(b) by 102 days.

(21) Appl. No.: 13/320,739

(22) PCT Filed: May 13, 2010

(86) PCT No.: PCT/US2010/034734

§ 371 (c)(1),
(2), (4) Date: Nov. 15, 2011

(87) PCT Pub. No.: WO2010/132680

PCT Pub. Date: Nov. 18, 2010

(65) Prior Publication Data

US 2012/0064503 A1 Mar. 15, 2012

Related U.S. Application Data

(60) Provisional application No. 61/178,788, filed on May 15, 2009.

(51) Int. Cl.

| | |
|---|---|
| ***B43L 1/00*** | (2006.01) |
| ***G09F 7/04*** | (2006.01) |
| ***G09F 7/18*** | (2006.01) |

(52) U.S. Cl.

CPC ... *G09F 7/04* (2013.01); *G09F 7/18* (2013.01)

USPC ..... 434/408; 434/365

(58) Field of Classification Search

USPC ..... 434/408, 414, 419; 248/201, 274.1, 248/222.12, 133

See application file for complete search history.

(56) References Cited

U.S. PATENT DOCUMENTS

| | | | |
|---|---|---|---|
| 3,556,047 | A | 1/1971 | Wassell |
| 3,716,935 | A | 2/1973 | Friederichs |

(Continued)

FOREIGN PATENT DOCUMENTS

| | | |
|---|---|---|
| CN | 1445106 | 10/2003 |
| EP | 2011417 | 7/2009 |

(Continued)

*Primary Examiner* — Timothy A Musselman

(74) *Attorney, Agent, or Firm* — Troutman Sanders LLP; Ryan A. Schneider; Christopher W. Glass

(57) ABSTRACT

Mounting systems can releasably secure display devices to preexisting surfaces for convenient installation and removal without external tools. A mounting system can comprise lower magnetic assemblies, upper magnetic assemblies, and a mounting sheet. The lower magnetic assemblies can be secured to a rear surface of a display device, for releasably attaching the display device to a preexisting surface. A bottom portion of the mounting sheet can be secured to the rear surface of the display device, while a top portion of the mounting sheet can remain loose from the rear surface. The upper magnetic assemblies can be provided along the loose top portion of the mounting sheet, for releasably attaching the display device to the preexisting surface. The upper magnetic assemblies can retain their connection to the preexisting surface as the display device is pulled away from the preexisting surface, until a threshold condition is met.

31 Claims, 12 Drawing Sheets

(56) References Cited

U.S. PATENT DOCUMENTS

| | | | | |
|---|---|---|---|---|
| 3,984,944 | A | 10/1976 | Maasberg et al. | |
| 4,023,290 | A | 5/1977 | Josephson | |
| 4,211,382 | A | 7/1980 | Bonfils | |
| 4,584,223 | A | 4/1986 | Krapf | |
| 4,635,410 | A | 1/1987 | Chumbley | |
| 4,825,526 | A | 5/1989 | Shenier et al. | |
| 4,875,654 | A | 10/1989 | Chandonnet et al. | |
| 4,996,110 | A | 2/1991 | Tanuma et al. | |
| 5,025,918 | A * | 6/1991 | Bergeron | 206/750 |
| 5,295,342 | A | 3/1994 | Roche et al. | |
| 5,352,535 | A | 10/1994 | Su | |
| 5,388,382 | A | 2/1995 | Brooks | |
| 5,393,232 | A | 2/1995 | Haines | |
| 5,501,603 | A | 3/1996 | Mueller et al. | |
| 5,516,581 | A | 5/1996 | Kreckel et al. | |
| 5,518,217 | A | 5/1996 | Deutsch et al. | |
| 6,052,933 | A | 4/2000 | Lytle | |
| 6,189,268 | B1 | 2/2001 | Carr et al. | |
| 6,328,571 | B1 | 12/2001 | Dricken et al. | |
| 6,334,602 | B1 | 1/2002 | Clarke | |
| 6,491,271 | B1 | 12/2002 | Adams | |
| 6,612,077 | B2 | 9/2003 | Parshad | |
| 6,948,210 | B1 | 9/2005 | Shah | |
| 2005/0167547 | A1 * | 8/2005 | McLellan | 248/74.4 |
| 2007/0015120 | A1 | 1/2007 | Ide | |
| 2008/0010923 | A1 | 1/2008 | MacGregor et al. | |
| 2008/0248456 | A1 | 10/2008 | Cheris et al. | |
| 2008/0283694 | A1 * | 11/2008 | VanLanen et al. | 248/133 |
| 2009/0068632 | A1 | 3/2009 | Thompson et al. | |

FOREIGN PATENT DOCUMENTS

| | | |
|---|---|---|
| JP | 2000238492 | 9/2000 |
| JP | 2001039088 | 2/2001 |
| JP | 2001246897 | 9/2001 |
| JP | 2004305723 | 11/2004 |
| JP | 2005218487 | 8/2005 |
| JP | 2007331231 | 12/2007 |
| WO | 2007099280 | 9/2007 |

* cited by examiner

DISPLAY MOUNTING SYSTEMS

CROSS-REFERENCE TO RELATED APPLICATION

This application is a United States National Stage Application of International Patent Application Serial No. PCT/US2010/034734, filed 13 May 2010, which claims a benefit, under 35 U.S.C. §119(e), of U.S. Provisional Application Ser. No. 61/178,788, filed 15 May 2009. The entire contents and substance of both of which are hereby incorporated by reference.

TECHNICAL FIELD

Various embodiments of the present invention relate to mounting systems and, more particularly, mounting systems for releasably securing display panels to preexisting surfaces.

BACKGROUND

Non-electronic whiteboards are becoming objects of the past. Currently, many organizations are replacing non-electronic whiteboards with electronic whiteboards or other electronic display systems. Installation of electronic display systems is only moderately difficult in new constructions. In contrast, installing electronic display systems in already existing facilities proves difficult and expensive, as such installation often requires uninstalling a non-electronic whiteboard before installing an electronic display system. Typically, a whiteboard is firmly secured to a wall with brackets or other hardware, and it may be difficult or inconvenient to remove that hardware. Further, removal of the whiteboard can damage the underlying wall. After the whiteboard is removed, a display for an electronic display system must then be installed to the wall with additional hardware. In short, replacing a non-electronic whiteboard with an electronic display system can be a long, strenuous, and inconvenient task.

SUMMARY

Briefly described, various embodiments of the present invention are mounting systems and display devices incorporating mounting systems. According to some embodiments, the mounting system can be used to install a new display device over a preexisting surface, such as a conventional whiteboard or other old display board. The mounting system can position and releasably secure the new display device on top of the preexisting surface without damaging the preexisting surface. Thus, the mounting system can enable convenient installation and removal of the new display device with little or no use of external tools. In an exemplary embodiment, the mounting system can comprise one or more lower magnetic assemblies, one or more upper magnetic assemblies, and one or more mounting sheets, all of which can be connected to or integrated with a display device to be installed over a preexisting surface.

The display device can be part of, or useable with, an electronic whiteboard system or other electronic display system. For example and not limitation, the display device can be a specialized whiteboard, with which a user can interact to drive an electronic display system. The mounting assembly can be connected the display device for releasably securing the display device to a preexisting surface, such as a conventional whiteboard. Thus, the display device can be installed over a conventional whiteboard to enable use of the electronic display system, in place of the conventional whiteboard.

The lower magnetic assemblies of the mounting system can be connected to a bottom portion of a rear surface of the display device. The lower magnetic assemblies can be used to connect the bottom portion of the display device to a preexisting surface, such as a conventional whiteboard surface.

One or more mounting sheets can be provided along a top portion of the rear surface of the display device. The mounting sheets can be composed of a flexible material, such as a polymer. A bottom portion of each mounting sheet can be attached to the rear surface of the display, while a top portion of the mounting sheet can remain substantially loose from the rear surface. One or more upper magnetic assemblies can be provided along the top portion of the mounting sheet. Attached to the loose top portion of the mounting sheet, the upper magnetic assemblies can be moveable with respect to the display device.

When the bottom of the display device is slightly displaced from the preexisting surface, the upper magnetic assemblies can remain attached to the preexisting surface as the mounting sheet flexes. In an exemplary embodiment, a lower portion of the display device can be displaced from the preexisting surface by approximately 30-45 degrees before the display is disconnected from the preexisting surface. Accordingly, the mounting system provides convenient installation and reduces accidental removal of the display from the preexisting surface.

These and other objects, features, and advantages of the mounting system will become more apparent upon reading the following specification in conjunction with the accompanying drawing figures.

DETAILED DESCRIPTION

Figure 1:
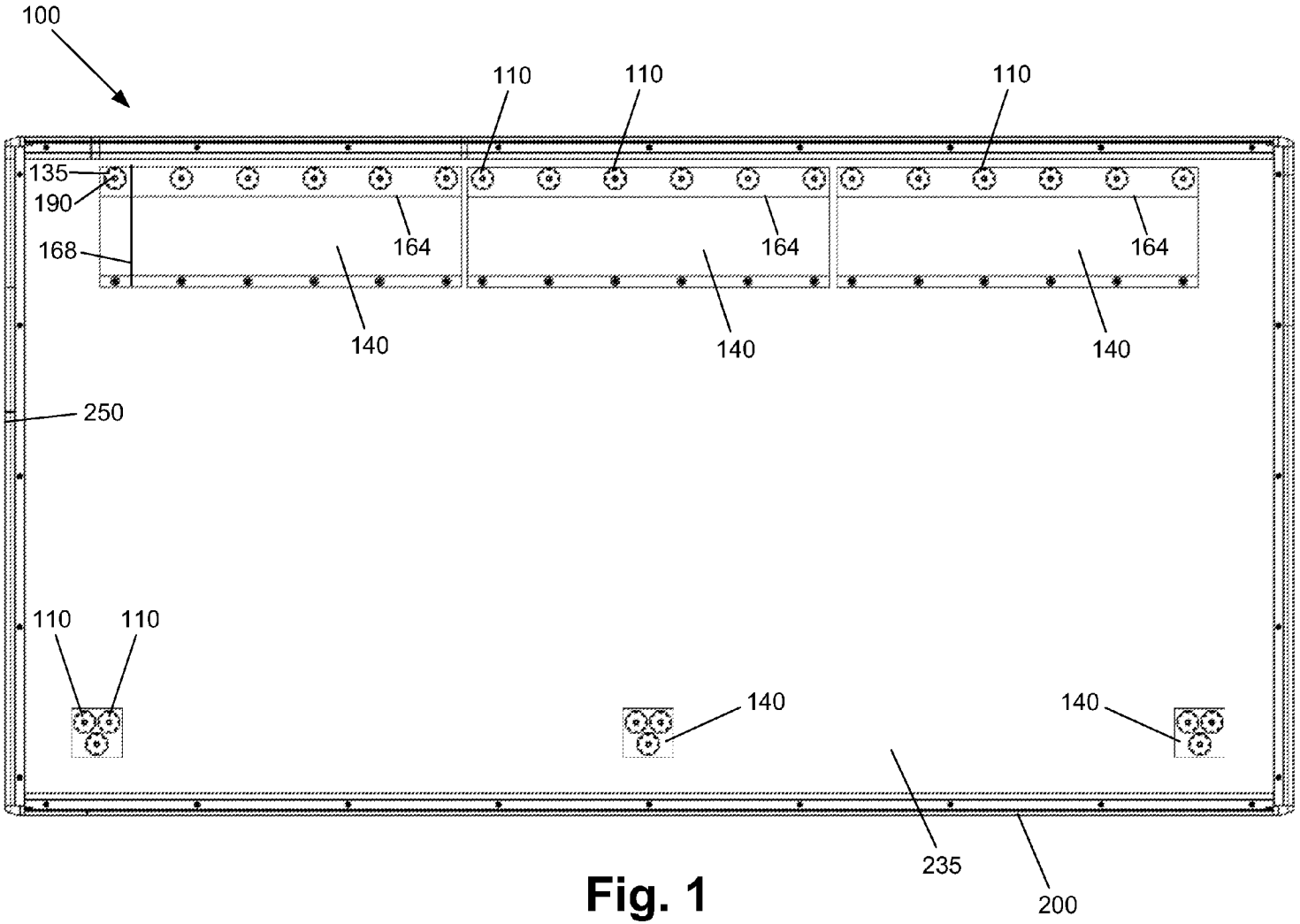
FIG. 1 illustrates a mounting system on a rear surface of a display device, according to an exemplary embodiment of the present invention.

To facilitate an understanding of the principles and features of the invention, various illustrative embodiments are explained below. In particular, embodiments of the invention are described in the context of being a mounting system for a display device of an electronic whiteboard system. Embodiments of the invention, however, are not limited to electronic whiteboard systems. Rather, embodiments of the invention can comprise mounting systems for display devices of various electronic display systems and other objects.

The materials and components described hereinafter as making up various elements of the invention are intended to be illustrative and not restrictive. Many suitable materials and components that would perform the same or similar functions as the materials and components described herein are intended to be embraced within the scope of the invention. Other materials and components that are embraced but not described herein include, but are not limited to, for example, similar or analogous components developed after development of the invention.

Various embodiments of the present invention are mounting systems and display devices incorporating mounting systems. According to some embodiments of the present invention, a mounting system is a connective backer, such as a magnetic backer configured to adapt an object to hang on a conductive surface. A display device, according to some embodiments of the present invention, can be a displayable object having a connective backer, such as a magnetic backer for mounting the display device to a conductive surface.

Referring now to the figures, in which like reference numerals represent like parts throughout the views, the mounting system will be described in detail.

FIG. 1 illustrates a diagram of a display device 200 incorporating a mounting system 100, according to an exemplary embodiment of the present invention. As shown in FIG. 1, the mounting system 100 can be in communication with a rear surface 235 of the display device 200. The mounting system 100 can comprise one or more attachment assemblies 110, which can be attached to the display device 200 by one or more mounting sheets 140.

The mounting system 100 is configured to conveniently mount the display device 200 over a preexisting surface 500 (see FIG. 2), such as a conventional, non-electronic whiteboard surface. Configuration of the attachment assemblies 110 and the mounting sheets 140 can enable the display device 200 to be conveniently and releasably secured to the preexisting surface 500. In an exemplary embodiment, removing the mounted display device 200 from the preexisting surface 500 should not be so easy as to allow accidental removal. The mounting system 100 can be configured to allow a portion of the display device 200 to be lifted away from the preexisting surface 500 to some degree without completely disconnecting the display device 200 from the preexisting surface 500.

The display device 200 can be one of various types of display devices useable for various purposes. For example, the display device 200 can be a non-electronic whiteboard, artwork, or various other objects that can benefit from being mounted. In an exemplary embodiment, the display device 200 is part of an electronic display system 300, such as the electronic display system 300 illustrated in FIG. 2. The electronic display system 300 can have various forms. For example and not limitation, the electronic display system 300 can be the same or similar to those described in U.S. patent application Ser. Nos. 12/138,759 and 12/138,933, both filed 13 Jun. 2008. These patent applications are incorporated herein by reference as if fully set forth below.

Figure 2:
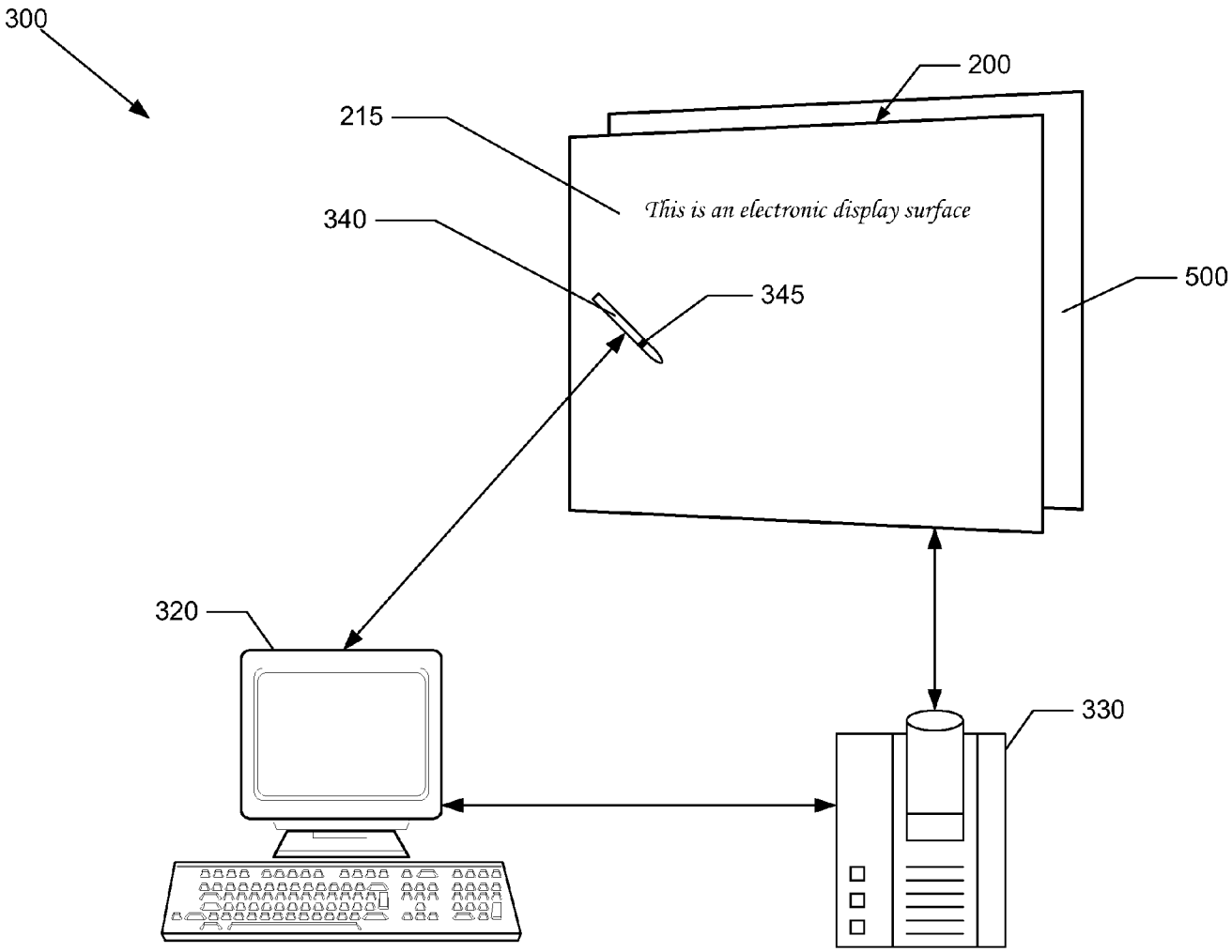
FIG. 2 illustrates a diagram of an electronic display system having a display device incorporating the mounting system, according to an exemplary embodiment of the present invention.

As illustrated in FIG. 2, the electronic display system 300 can include the display device 200, a processing device 320, a projector 330, and an input device 340.

The display device 200 can comprise a display surface 215, on which physical markings and physical representations of digital markings can be viewable. As a component of the electronic display system 300, the display surface 215 can receive and display various objects, including physical markings and images projected onto the display surface 215. The display device 200 need not comprise internal electronics and can be a passive component. For example and not limitation, the display device 200 can be a non-electronic surface, such as a standard or specialized whiteboard. The display surface 215 can receive physical markings or touches from a user, and can present images that are projected onto the display surface 215. In some other embodiments, however, the display device 200 can be an electronic display device comprising various internal electronics components enabling the display device 200 to independently display digital markings or images on the display surface 215.

In an exemplary embodiment, a position-coding pattern 400 (see FIG. 3) can be provided on the display surface 215. The pattern 400 can enable the input device 340 to sense an indication of its position on or proximate the display surface 215 by viewing, or otherwise sensing, a local portion of the pattern 400. When the input device 340 interacts with the display surface 215, the input device 340 can obtain position data by capturing one or more images of a portion of the pattern 400 on the display surface 215. The electronic display system 300 can analyze the captured images to determine how the input device 340 interacts with the display surface 215.

The input device 340 can comprise a sensing device 345, such as a camera or other image-capture device. With the sensing device 345, the input device 340 can detect an indication of its position based on the pattern 400 of the display surface 215. The input device 340 can be in communication with the processing device 320. For example, a wired or wireless connection can exist between the input device 340 and the processing device 320. The input device 340 can transmit data relating to its position to the processing device 320. Movement of the input device 340 can be interpreted by the processing device 320 as performance of one or more operations on the display surface 215.

The processing device 320 can be configured to receive position data relating to a position of the input device 340, and to map the position data to one or more operations and target coordinates on the display surface 215. The processing device 320 can determine how to update an old image displayed on the display surface 215. The processing device 320 can render a new display image based on the old image, the target coordinates, and the current operating mode. The processing device 320 can then transmit the new image to the projector 330 for display on the display surface 215.

The projector 330 can project one or more images onto the display surface 215 based on instructions from the processing device 320.

As briefly mentioned above, a position-coding pattern 400 can be provided on the display surface 215 of the mountable display device 200. The pattern 400 can enable the input device 340 to sense an indication of its position on the display surface 215 by viewing, or otherwise sensing, a local portion of the pattern 400. Various images can be used for the pattern 400. The implemented pattern 400 can indicate the position of the input device 340 relative to a previous position, or can indicate an absolute position of the input device 340 in the coordinate system of the display surface 215. For example, the display surface 215 can comprise a known image, which can include alphanumeric characters, a coding pattern, or many other discernable patterns or image data capable of indicating relative or absolute position on the display surface 215.

Figure 3:
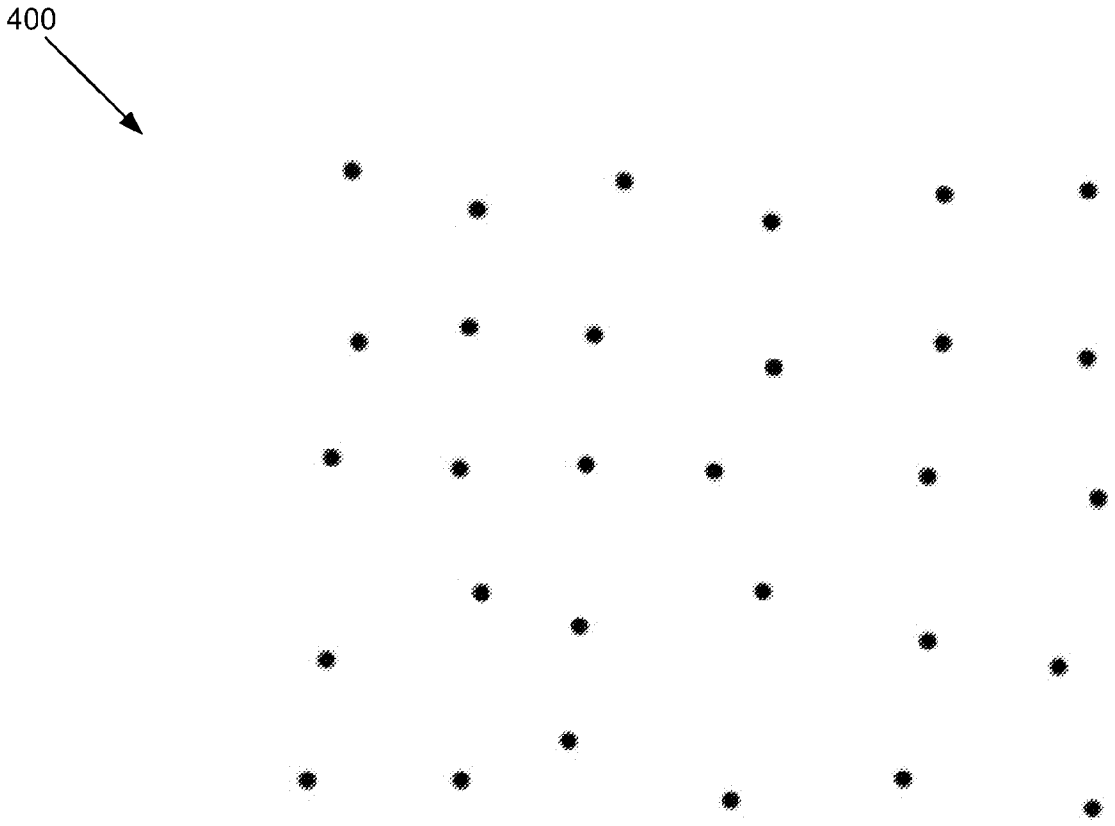
FIG. 3 illustrates a dot pattern on a display surface of the display device, according to an exemplary embodiment of the present invention.

In an exemplary embodiment of the display surface 215, the position-coding pattern 400 can be a dot matrix position-coding pattern, or dot pattern, such as that illustrated in FIG. 3. The pattern 400 can encode coordinates of positions on the display surface 215 and can be designed to provide indication of an absolute position of the input device 340 in a coordinate system of the display surface 215. When the input device 340 interacts with the display surface 215, the input device 340 can obtain position data by capturing one or more images of a portion of the pattern 400 on the display surface 215. The input device 340 or the processing device 320 can then decode such position data. As a result, movement of the input device 340 across the display surface 215 can be determined as a series of coordinates on the display surface 215.

The pattern 400 can, but need not, be detectable by the human eye. Preferably, the pattern 400 is not so noticeable as to distract a viewer of the display surface 215 from markings or images displayed on the display surface 215. For example, in an exemplary embodiment, the display surface 215 can appear to have a uniform, light grey color.

Referring back to FIG. 2, the mounting system 100 can enable the display device 200 of the electronic display system 300 to be mounted onto a preexisting surface 500, such as a conventional whiteboard. Accordingly, with the mounting system 100, the preexisting surface 500 can be adapted to support the display device 200 for operation in the electronic display system 300.

Figure 4:
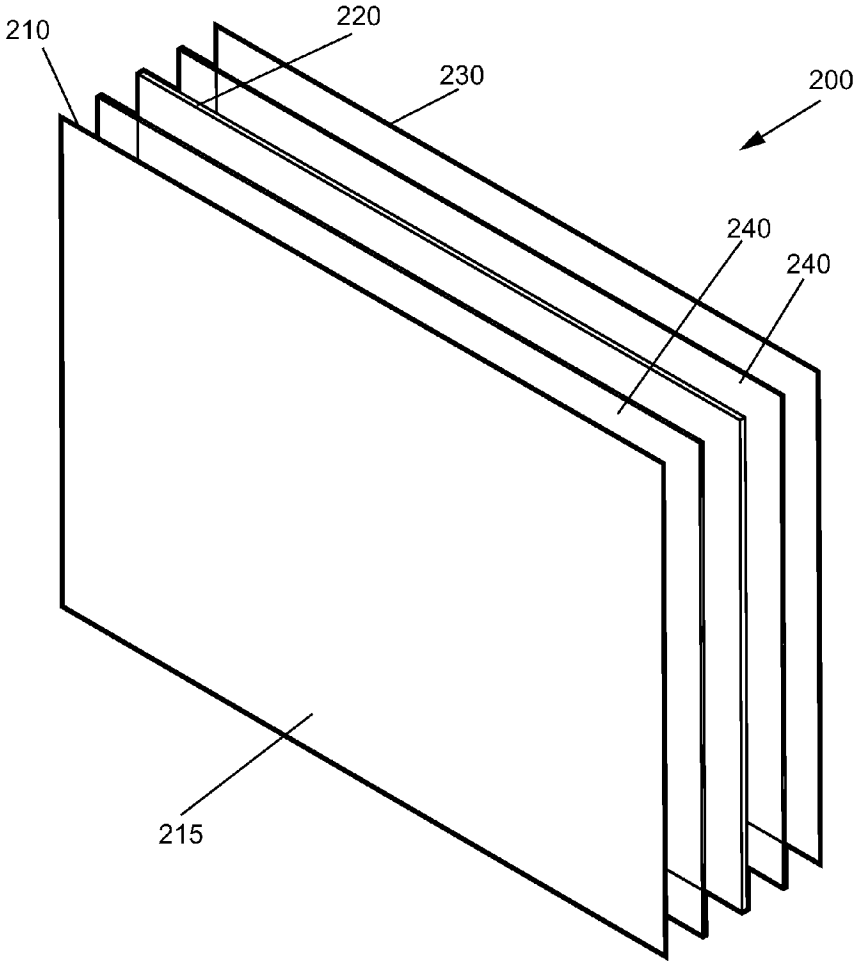
FIG. 4 illustrates an exploded perspective view of various layers of the display device, according to an exemplary embodiment of the present invention.

FIG. 4 illustrates an exploded perspective view of an exemplary embodiment of the display device 200. As shown in FIG. 4, the display device 200 can contain one or more layers. For example, the display device 200 can contain a front layer 210, a core 220, and a backer 230. Each layer 210, 220, or 230 can be secured to an adjacent layer 210, 220, or 230 by an adhesive 240. The adhesive can be glue, tape, or many other materials capable of securing the layers 210, 220, and 230 together. The display surface 215 can be a face of the front layer 210.

The various layers 210, 220, and 230 can comprise many materials. A material for the front layer 210 can be selected to be slightly flexible, such that the display device 200 flexes slightly when a user contacts it. For example and not limitation, the front layer 210 can be an enameled steel or ceramic-steel panel, which can comprise a ceramic sub-layer and a steel sub-layer. In an exemplary embodiment, the ceramic sub-layer can face the display surface 215. The core 220 can also be various materials. In an exemplary embodiment, the core 220 can comprise cardboard, corrugated paper, particle board, honeycomb paper, aluminum, or many other light-weight materials. Selecting a sufficiently lightweight material for the core 220 can cause the entire display device 200 to be light enough to be supported by the mounting system 100. The backer 230 can be comprised of a material capable of supporting the structure of the display device 200. Additionally, the backer 230 can protect other layers 210 and 220 of the display device 200 from moisture, which could potentially damage the display device 200. For example, in an exemplary embodiment, the backer 230 can comprise galvanized steel or another solid, sturdy material.

Materials of the various layers 210, 220, and 230 can reduce, or prevent, warping of the display device 200. A material of the backer 230 can be selected to provide a balanced construction to minimize warping. Further, the front layer 210 and the backer 230 can be composed of materials that expand and contract to similar degrees as a result of temperature changes, as is the case with a ceramic-steel front layer 210 and a galvanized steel backer 230. The front layer 210 and the backer 230 can further reduce warping by sufficiently securing the core 220 to reduce undesirable movement of the core 220.

Figure 5:
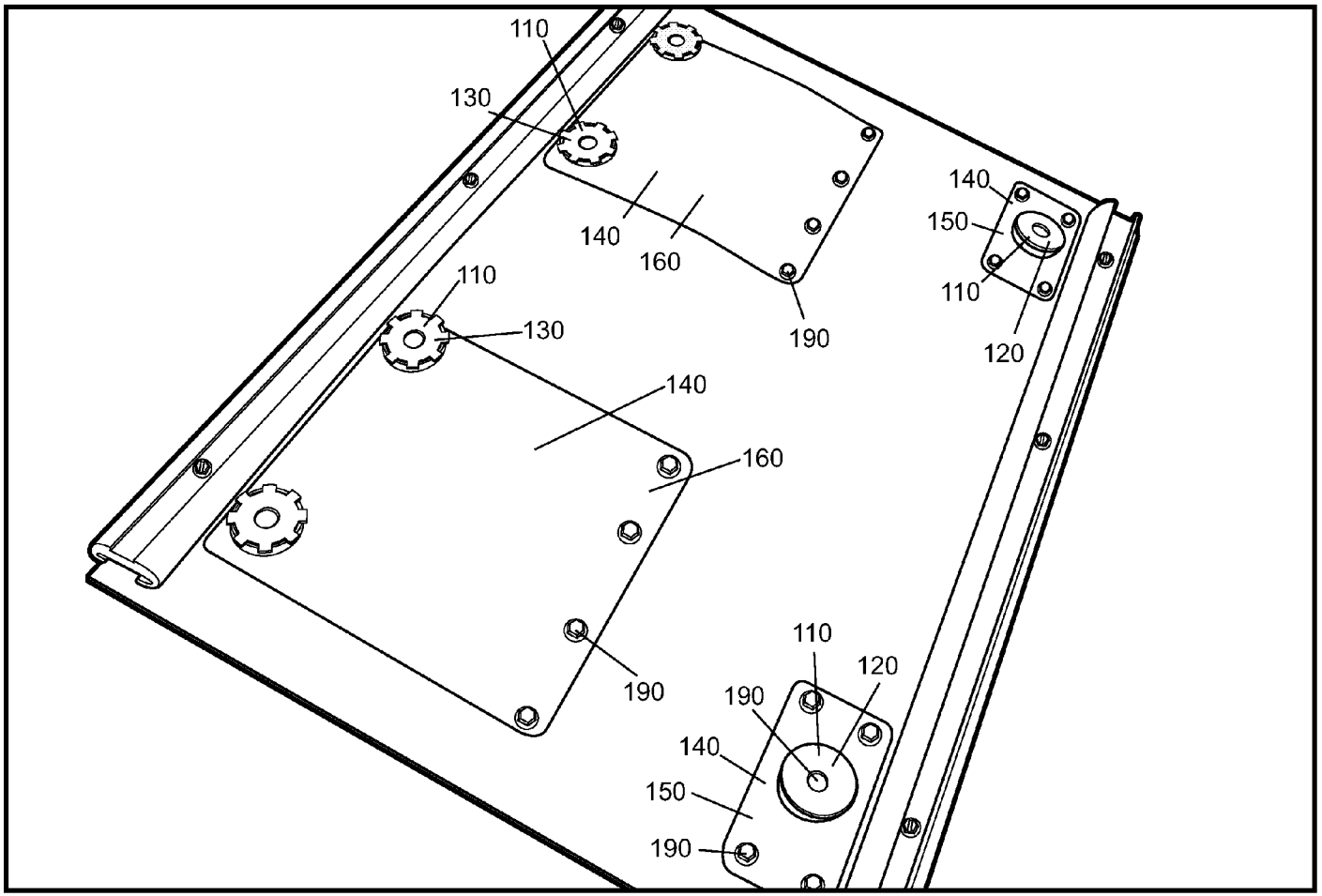
FIG. 5 illustrates a rear perspective view of the display device incorporating the mounting system, according to an exemplary embodiment of the present invention.

FIG. 5 illustrates a rear perspective view of an exemplary display device 200 incorporating the mounting system 100. As shown in FIG. 5, the attachment assemblies 110, or attachment devices, can include lower attachment assemblies 120 and upper attachment assemblies 130. Analogously, the mounting sheets 140 can include lower mounting sheets 150 and upper mounting sheets 160.

In an exemplary embodiment, the mounting sheets 140 can comprise a flexible material, such as a polymer. The mounting sheets 140 can be connected to, and carried by, the rear surface 235 of the display device 200, and the attachment assemblies 110 can be connected to, and carried by, the mounting sheets 140. More specifically, the lower attachment assemblies 120 can be carried by the lower mounting sheets 150, and the upper attachment assemblies 130 can be carried by the upper mounting sheets 160. When the display device 200 is installed over a preexisting surface, however, the mounting assembly, including the mounting sheets 140 and attachment assemblies 110, can carry the display device 200 on the preexisting surface.

A lower mounting sheet 150 can be substantially secured to the rear surface 235 of the display device 200. For example, as shown in FIG. 5, each lower mounting sheet 150 can be attached to the rear surface 235 at each of the four corners of the lower mounting sheet 150. Alternatively, the lower mounting sheet 150 can be secured to the rear surface 235 along two opposing edges of the lower mounting sheet 150. The lower mounting sheet 150 is secured to rear surface 235 of the display device 200 such that portions proximate the various corners of the lower mounting sheet 150 are attached to the rear surface 235.

Securement of the lower mounting sheet 150 to the rear surface 235 of the display device 200 can be effected by various means. For example, at least one attachment member 190 can be provided to attach the lower mounting sheet 150 to the rear surface 235 at each of various points. The attachment members 190 can comprise rivets, screws, nails, bolts, adhesives, or the like.

Figure 6:
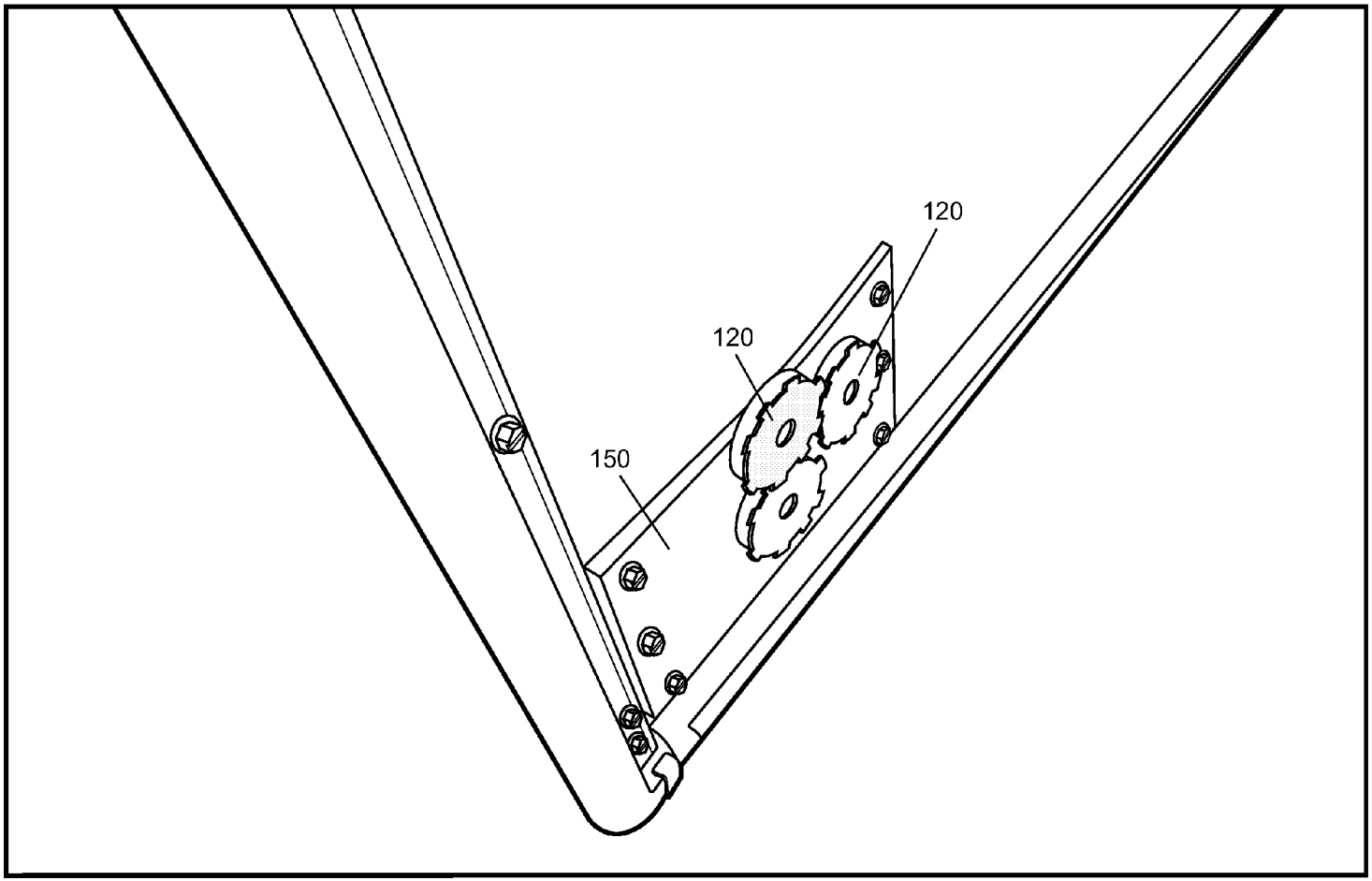
FIG. 6 illustrates a set of lower attachment assemblies of the mounting system, according to an exemplary embodiment of the present invention.

One or more lower attachment assemblies 120 can be secured to each lower mounting sheet 150. Each lower attachment assembly 120 can be attached to the lower mounting sheet 150 by an attachment member 190. Although a single lower attachment assembly 120 is provided per lower mounting sheet 150 in the mounting system 100 of FIG. 5, FIG. 6 illustrates an alternative configuration of lower attachment assemblies 120. As shown in FIG. 6, multiple lower attachment assemblies 120 can be secured to each lower mounting sheet 150.

As described in detail below, the upper mounting sheets 160 can extend between the upper attachment assemblies 130 and the display device 105, when the lower attachment assemblies 120 are pulled away from the preexisting surface 500, so as to allow the upper attachment assemblies 130 to remain secured to the preexisting surface until a threshold condition is met. In contrast, the lower mounting sheets 150 need not enable the lower attachment assemblies 120 to remain secured to the preexisting surface 500 when the display device is displaced from the preexisting surface 500. The lower mounting sheets 150 can be provided to position the lower attachment assemblies 120 such that the outermost portions of the lower attachment assemblies 120 are approximately the same distance from the display device 105 as are the outermost portions of the upper attachment assemblies 130. Various other implementations can be provided to achieve this effect, however, and no lower mounting sheets 150 need be provided. For example and not limitation, a spacer or spacing member can be positioned between the lower attachment assemblies 120 and the display device, or the lower attachment assemblies 120 can be thicker components than the upper attachment assemblies and can be secured directly to the display device 105.

Figure 7:
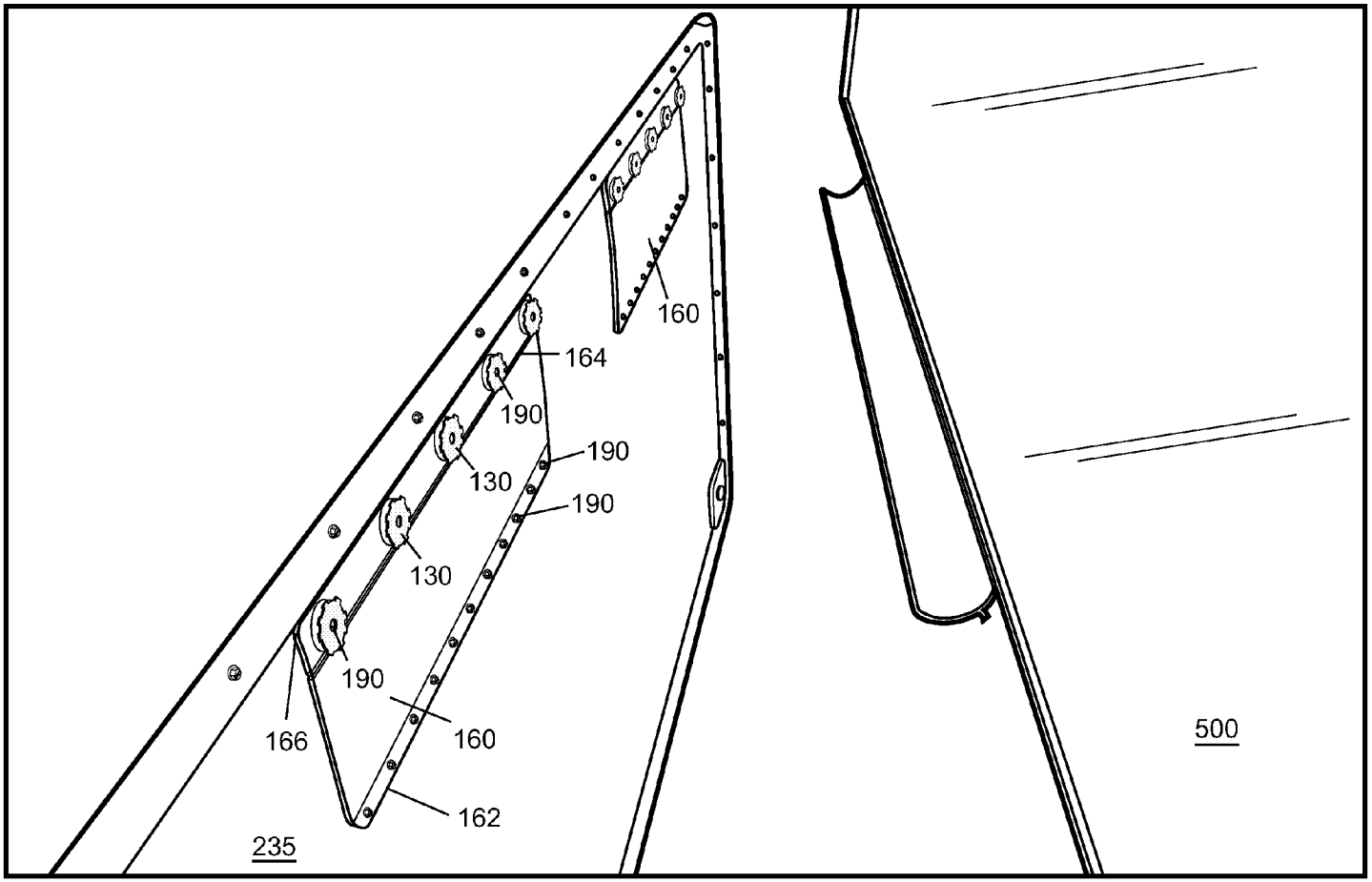
FIG. 7 illustrates a rear perspective view of another display device incorporating the mounting system, according to an exemplary embodiment of the present invention.

FIG. 7 illustrates an exemplary embodiment of a configuration of upper attachment assemblies 130 and upper mounting sheets 160. While certain illustrative embodiments of upper mounting sheets 160 are described below, various other embodiments can be provided to extend between the upper attachment assemblies 130 and the display device 105, to maintain a connection between the display device 105 and the preexisting surface 500 when the display device 105 is pulled away from the preexisting surface.

As shown in FIG. 7, multiple upper mounting sheets 160 can be provided along a top portion 260 of the display device 200. The length of an upper mounting sheet 160, between where it is attached to the display device 200 and where the upper attachment assemblies 130 are positioned, can be selected to enable the display device 200 to be displaced from the preexisting surface 500 by a desirable distance or degree without being removed from the preexisting surface 500, as described further below. In an exemplary embodiment, that length of each upper mounting sheet 160 is approximately 7-8 inches.

Each upper mounting sheet 160 can be secured to the rear surface 235 of the display device 200 proximate a bottom edge 162 or other lower portion of the upper mounting sheet 160. Securement can be provided by one or more attachment members 190, which can comprise rivets, screws, bolts, nails, adhesives, or various other means of attachment.

An upper mounting sheet 160 can be a connective member between the display device and all or a subset of the upper attachment assemblies 130. One or more upper attachment assemblies 130 can be provided along a top edge 166 of the upper mounting sheet 160. The upper attachment assemblies 130 can be secured to the upper mounting sheet 160 proximate the top edge 166 or upper portion of the upper mounting sheet 160. Securement of the upper attachment assemblies 130 to the upper mounting sheet 160 can be provided by one or more attachment members 190. Because the upper portion of the upper mounting sheet 160 can be loose and moveable with respect to the display device 200, the upper attachment assemblies 130 can also be moveable with respect to the display device 200, although remaining connected to the display device 200 by the lower portion of the upper mounting sheet 160.

A horizontal joint 164 can be provided in the upper mounting sheet 160 below the positions of the upper attachment assemblies 130. The upper mounting sheet 160 can be capable of bending abruptly along the horizontal joint 164. The horizontal joint 164 can be provided through many means. For example, the upper mounting sheet 160 can be perforated along a desired position of the horizontal joint 164. Alternatively, a groove can be cut in the upper mounting sheet 160 along a desired position of the horizontal joint 164.

Figure 8:
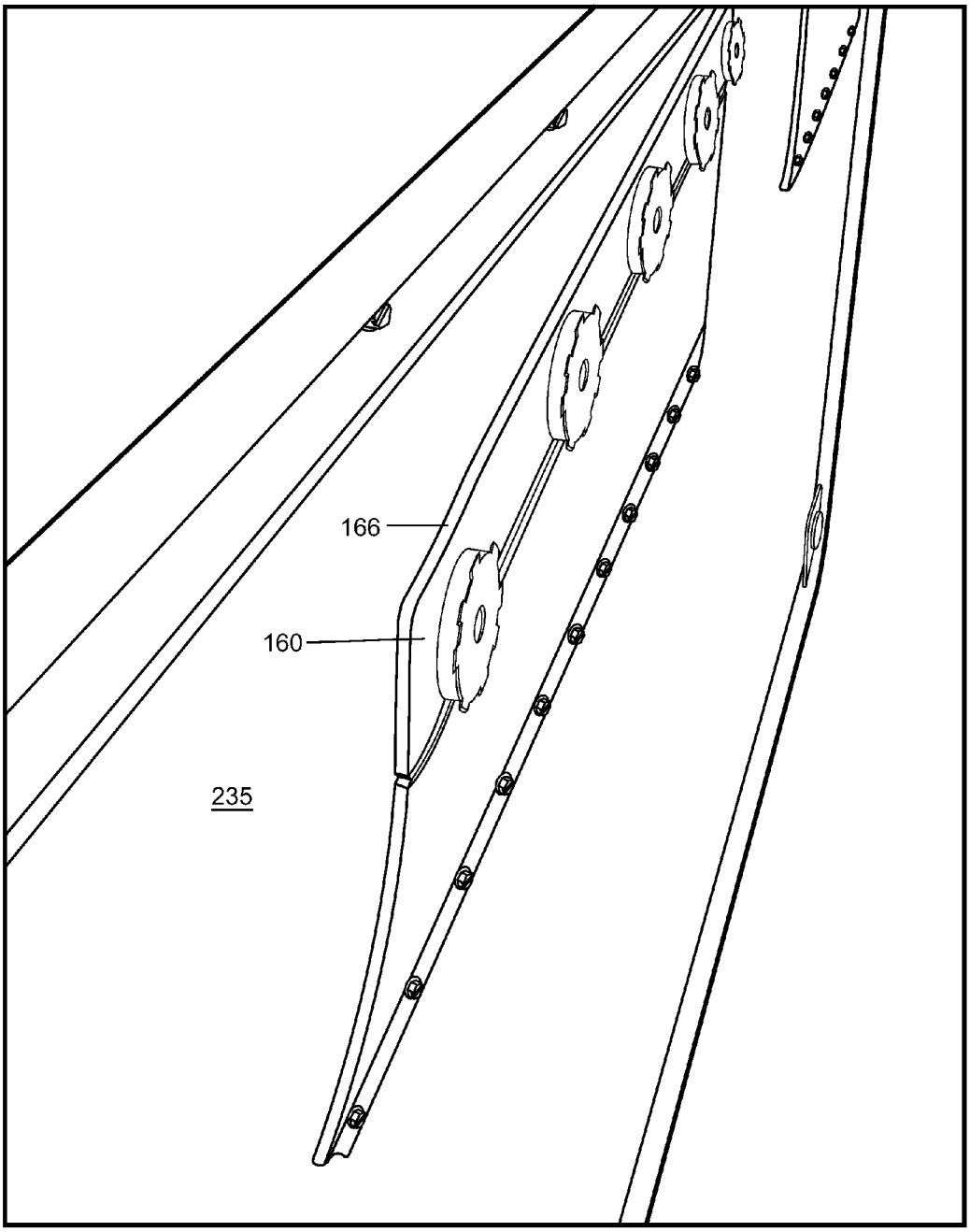
FIG. 8 illustrates another rear perspective view of the display device of FIG. 7, according to an exemplary embodiment of the present invention.

As illustrated in FIG. 8, in an exemplary embodiment, all or a portion of the top edge 166 of the upper mounting sheet 160 can remain unattached to the rear surface 235 of the display device 200. As a result of this configuration, the display device 200 can become displaced from one or more of the upper attachment assemblies 130 when a portion of the display device 200 is pulled away from the preexisting surface 500 on which the display device 200 is mounted. Thus, as long as the display device 200 is not sufficiently displaced from the preexisting surface, so as to exceed a threshold displacement range, the display device can remain connected to and mounted on the preexisting surface by the upper attachment assemblies 130 and the upper mounting sheet 160.

Figure 9:
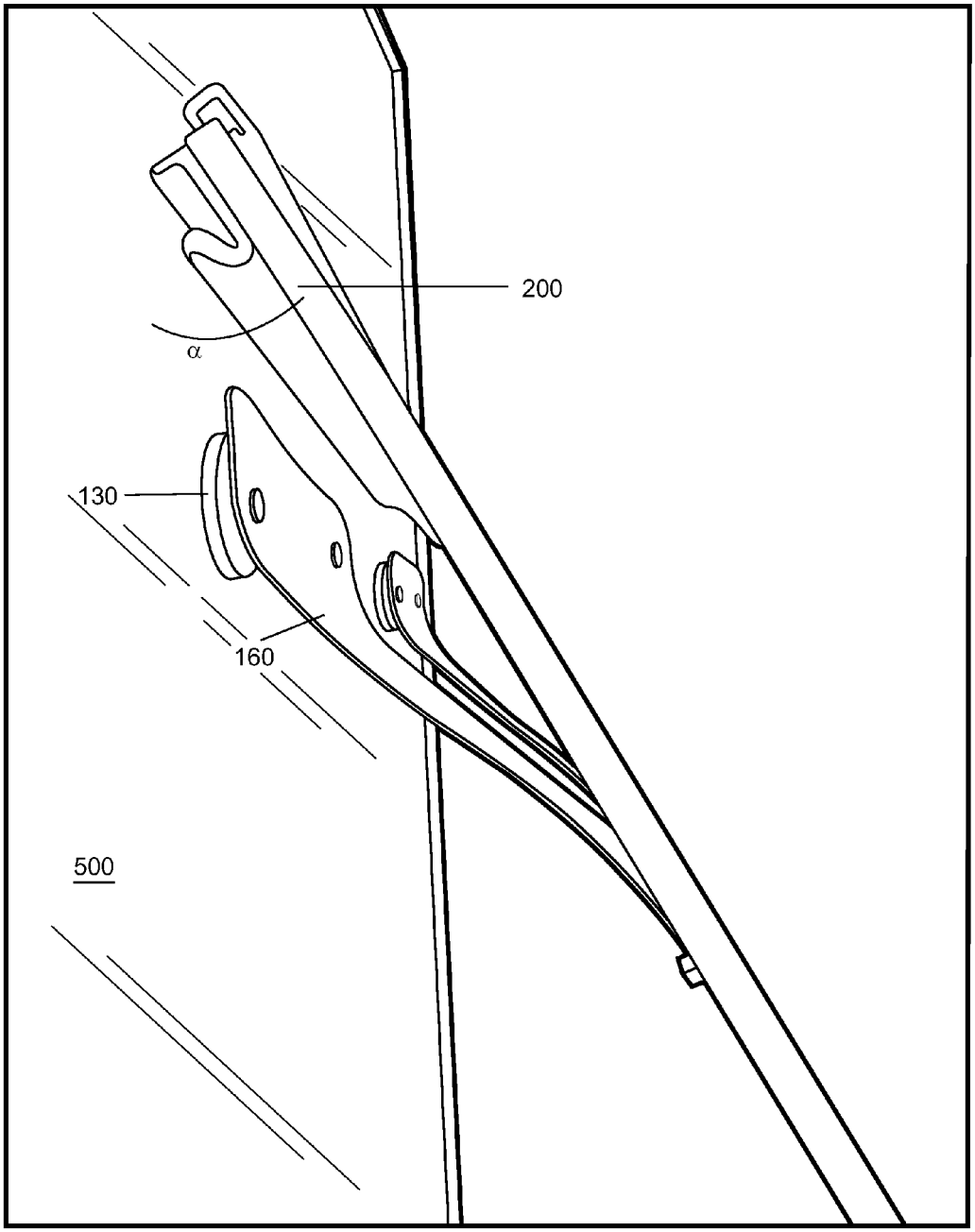
FIG. 9 illustrates a side view of the display device of FIG. 5 being pulled away from a mounting surface, according to an exemplary embodiment of the present invention.

FIG. 9 illustrates an exemplary configuration of the mounting system 100 when the bottom of the display device 200 is pulled away from the preexisting surface 500. As illustrated in FIG. 9, when the bottom of the display device 200 is pulled away from the preexisting surface 500, one or more of the upper attachment assemblies 130 can maintain their attachment to the preexisting surface 500. The flexibility of the upper mounting sheet 160, along with the horizontal joint 164 (not shown in FIG. 9), can assist in enabling one or more of the upper attachment assemblies 130 to remain generally flat against the preexisting surface 500 as a portion of the display device 200 is displaced from the preexisting surface 500. The upper mounting sheet 160 can flex, thereby allowing the top of the display device 200 to be forced upward and displaced from the upper mounting sheet 160, which can remain connected to the preexisting surface 500 by the upper attachment assemblies 130.

While the display device 200 remains mounted and secured to the preexisting surface, a lower portion of the display device 200 can be displaced from the preexisting surface 500 within a predetermined displacement range. The displacement range defines a threshold condition, such that the display device 200 can remain secured to the preexisting surface 500 by the mounting system 100, so long as the display device 200 remains within the displacement range. When the displacement of the display device 200 from the preexisting surface 500 exceeds the displacement range, the threshold condition is met, and thus, the upper mounting assemblies 130 automatically and mechanically detach from the preexisting surface 500.

The displacement range can include predetermined combinations of angles and distances by which the display device 200 can be displaced from the preexisting surface 500, before the upper attachment assemblies 130 detach from the preexisting surface, thereby disconnecting the display device 200 from the preexisting surface 500. The displacement range between the display device 200 and a preexisting surface 500 can depend on, and be defined by, one or more characteristics of the upper mounting sheet 160, the display device 200, and the preexisting surface 500. For example, the displacement range can depend on, a combination of the following: a length of the upper mounting sheet 160 between its attachment to the display device 200 and the positions of the upper attachment assemblies 130, a degree of flexibility of the upper mounting sheet 160, a curvature of the preexisting surface 500, a curvature of the display device 200, and a degree of flexibility of the display device 200.

For example, in some exemplary embodiments, the display device 200 can be pulled away from the preexisting surface 500 by no more than a threshold distance, which can be at least partially defined by the length of the upper mounting sheet 160 between its attachment to the display device 200 and the positions of the upper attachment assemblies 130. Because this length of the upper mounting sheet 160 can extend between the upper attachment assemblies 130 and the display device when the display device 200 is displaced, the upper attachment assemblies 130 can automatically detach from the preexisting surface 500 before the distance between the display device 200 and the preexisting surface exceeds this length. Additionally, in some embodiments, the display device 200 can be pulled away from the preexisting surface 500 by no more than a threshold angle $\alpha$, which can be approximately 30-45 degrees.

As illustrated in FIG. 1, one or more of the upper attachment assemblies 135 can be fixed, or rigid, with respect to the rear surface 235 of the display device 200. For example, the portion of the upper mounting sheet 160 on which these fixed upper attachment assemblies 135 are secured can be fixed to the rear surface 235 of the display device 200, thereby fixing these upper attachment assemblies 135 to the rear surface 235 as well. Alternatively, for another example, a fixed upper attachment assembly 135 can be secured to the rear surface 235 by providing an attachment member 190 from the fixed attachment assembly 135 through the upper mounting sheet 160 to the rear surface 235. Thus, each fixed upper attachment assembly 135 can be fixed to the rear surface 235 of the display device 200, instead of being loosely attached to the display device 200.

In an exemplary embodiment, the fixed upper attachment assemblies 135 can be grouped together without intervening unfixed assemblies 130, so that the group of fixed upper attachment assemblies 135 can be substantially immoveable with respect to the display device 200, while the remaining upper attachment assemblies 130 can be moveable with respect to the display device 200.

As also illustrated in FIG. 1, a vertical joint 168 can be provided in an upper mounting sheet 160. The vertical joint 168 can have a similar structure to the horizontal joint 164, but can be oriented vertically. Like the horizontal joint 164, the vertical joint 168 can comprise a perforation or groove in the upper mounting sheet 160. In an exemplary embodiment, the vertical joint 168 is a divider between fixed and unfixed upper attachment assemblies 130. For example, as shown in FIG. 1, the vertical joint 168 can separate the leftmost upper attachment assembly 135, which can be fixed to the rear surface 235 of the display device 200, from remaining upper attachment assemblies 130, which can be moveable relative to the display device 200.

The vertical joint 168 and the fixed attachment assemblies 135 can enable the display device 200 to be easily removed from the preexisting surface 500 when desired. When a user attempts to remove the display device 200 from the preexisting surface 500 by pulling at a portion of the display device 200 proximate the fixed attachment assemblies 135, the display device 200 can be removable from the preexisting surface 500 without the display device 200 needing to be displaced from the preexisting surface 500 by angle $\alpha$. Additionally, the fixed upper attachment assemblies 135 can provide stability to the display device 200 when the display device 200 is secured to the preexisting surface 500. Because of the potential mobility of the other, unfixed upper attachment assemblies 130 with respect to the display device 200, there can be a tendency for the display device 200 to shake or drift away from the preexisting surface 500. The fixed upper attachment assemblies 135 can reduce or eliminate this tendency by being substantially immoveable with respect to the display device 200 when secured to the preexisting surface 500.

Figure 10B:
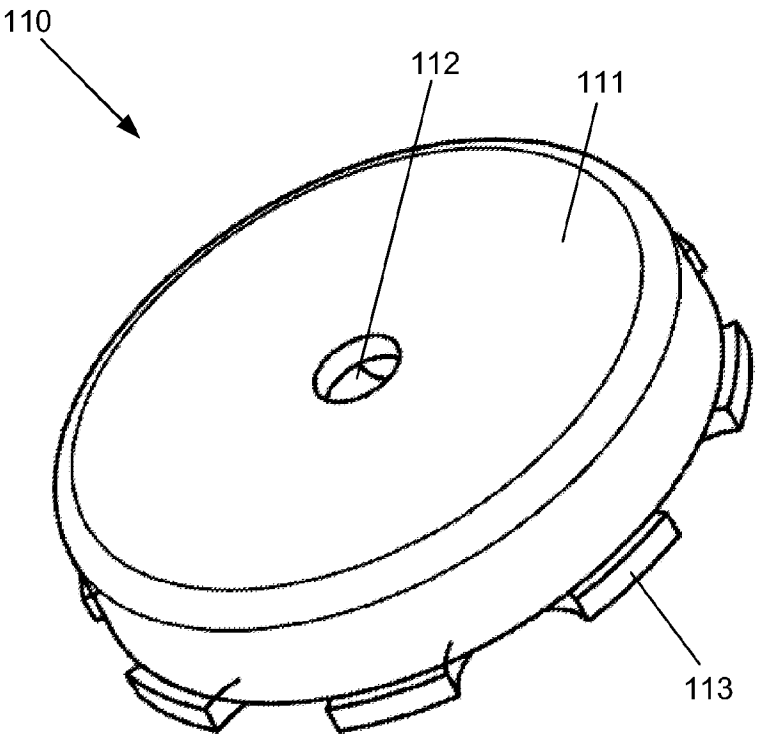
FIG. 10B illustrates a back perspective view of the attachment assembly of FIG. 10A, according to an exemplary embodiment of the present invention.
Figure 10A:
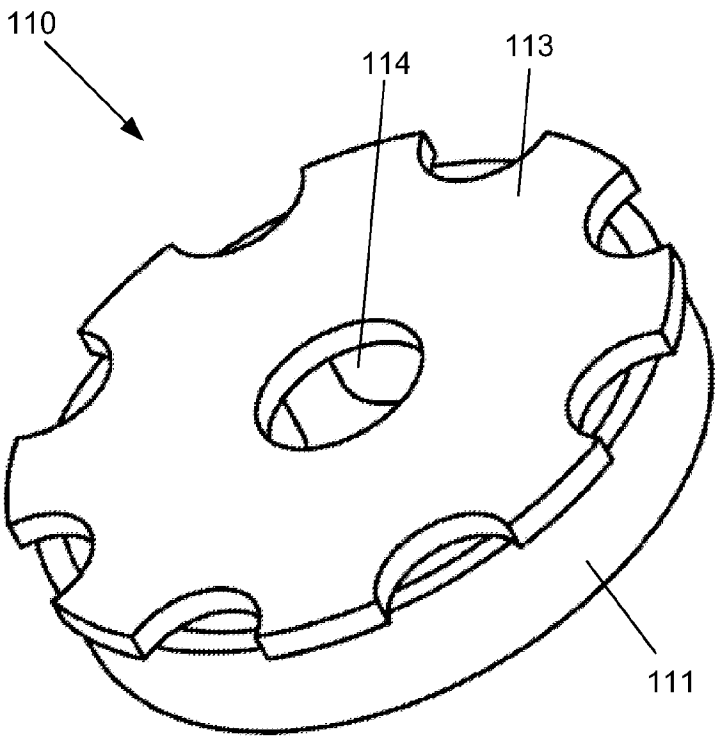
FIG. 10A illustrates a front perspective view of an attachment assembly of the mounting system, according to an exemplary embodiment of the present invention.

FIGS. 10A-10B illustrate perspective views of, respectively, a top and bottom of an exemplary attachment assembly 110, such as a lower or upper attachment assembly 120 or 130. The attachment assemblies 110 can be attached to the display device 200 in some manner and can be releasably attachable to the preexisting surface 500, to releasably secure the display device 200 to the preexisting surface 500. In some exemplary embodiments, the upper and lower attachment assemblies 120 and 130 can be magnetic assemblies, each comprising one or more magnets. When the preexisting surface 500 is a conductive surface, such as a conventional whiteboard, the magnetic assemblies 120 and 130 can releasably secure the display device 200 to the conductive, preexisting surface 500 as desired. The magnetic assemblies 120 and 130 can also repeatedly attach to and detach from the conductive, preexisting surface without the use of external tools and without damaging the preexisting surface 500.

As shown in FIGS. 10A-10B, an attachment assembly 110 can comprise a base 111 and a cover 113. The base 111 can define a base aperture 112, and the cover 113 can define a corresponding cover aperture 114. The base and cover apertures 112 and 114 can enable an attachment member 190 to fit through the attachment assembly 110 to secure the attachment assembly 110 to a mounting sheet 140 or the rear surface 235 of the display device 200.

A depth of the attachment assembly 110, from the top of the cover 113 to the bottom of the base 111, can be such that the rear surface 235 of the display device 200 is slightly separated from the preexisting surface 500. In an exemplary embodiment, the separation can be no narrower than an average-sized person's finger-tip. Thus, the separation can reduce the possibility of a person's hands, fingers, or other extremities being pinched between the display device 200 and the preexisting surface 500. Further, the attachment assemblies 110 can be positioned away from the edges of the display device 200, such that the display is separated from the preexisting surface 500 around the entire perimeter of the display. Accordingly, a person's extremities are unlikely to be pinched between an attachment assembly 110 and the preexisting surface 500.

Figure 11:
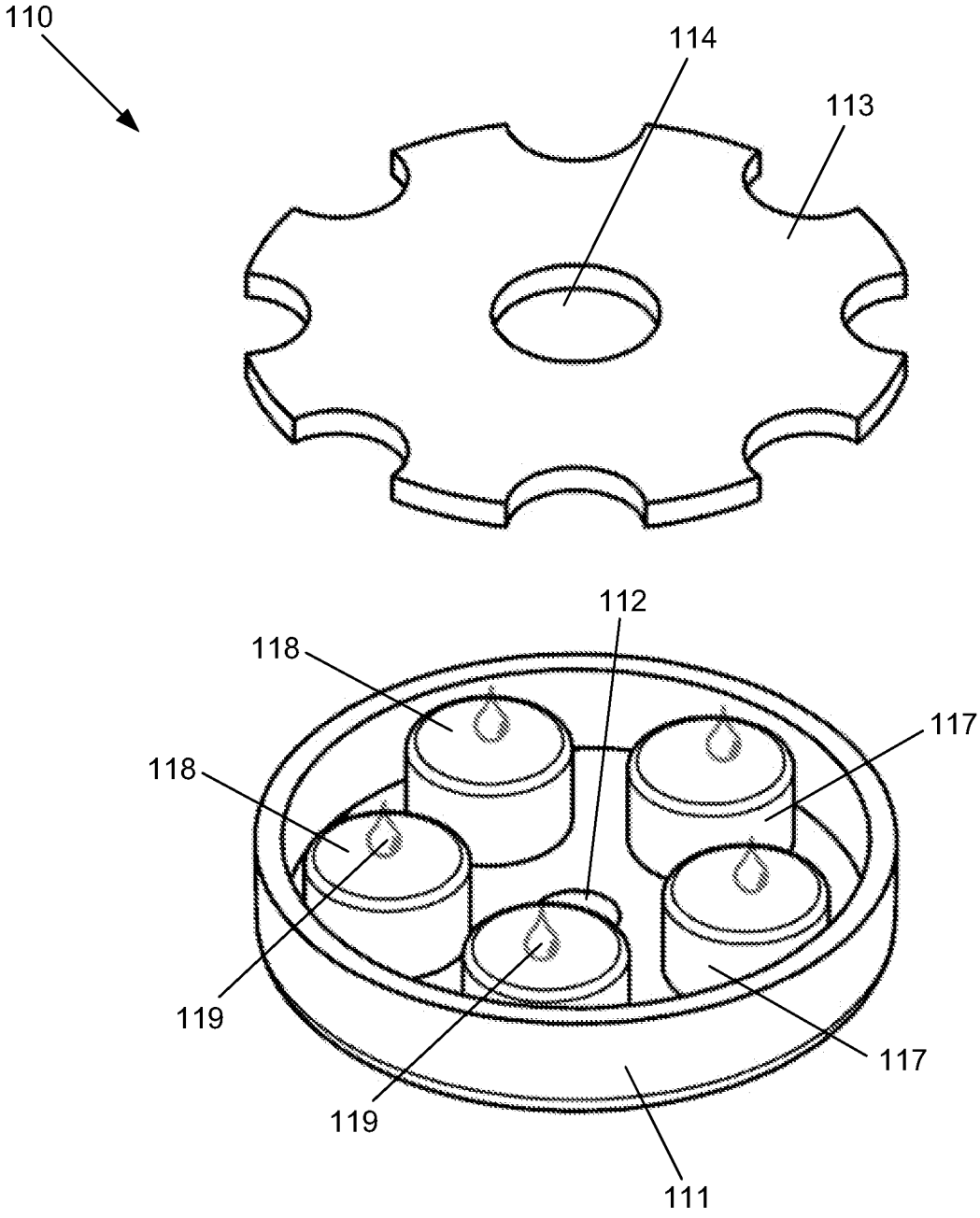
FIG. 11 illustrates a partially exploded perspective view of the attachment assembly of FIG. 10A, according to an exemplary embodiment of the present invention.

FIG. 11 illustrates a partially exploded perspective view of the attachment assembly 110. As shown, the attachment assembly 110 can comprise the base 111, the cover 113, and one or more magnets 118. The magnets 118 can be positioned, preferably uniformly, on an inner face 116 of the base 111. An inner container 117 can be provided for each magnet 118 to space the magnets 118 throughout the inner face 116. The inner container 117 can be various shapes, but preferably, each inner container 117 can be a shape that is complimentary to a shape of the magnet 118 it contains. For example, if the magnets 118 are cylindrical, as shown in FIG. 11, the inner containers 117 can be silo-shaped, as shown. An adhesive 119 can be provided to attach each magnet 118 to the cover 113 and the inner face 116 of the base 111.

It is not uncommon for magnets to slide down a surface to which they are attached when sufficient downward force is exerted on such magnets. Accordingly, while various types of magnets 118 can be provided in the attachment assembly 110, an exemplary embodiment of the attachment assembly 110 can utilize strong magnets, such as neodymium magnets. Additionally, the cover 113 can be or comprise a friction element 115, which can be a material capable of increasing friction between the attachment assembly 110 and the preexisting surface 500 upon which the display device 200 is mounted. For example and not limitation, the cover 113 can be composed of rubber, a nitrile pad, or many other friction-providing materials.

Figure 12:
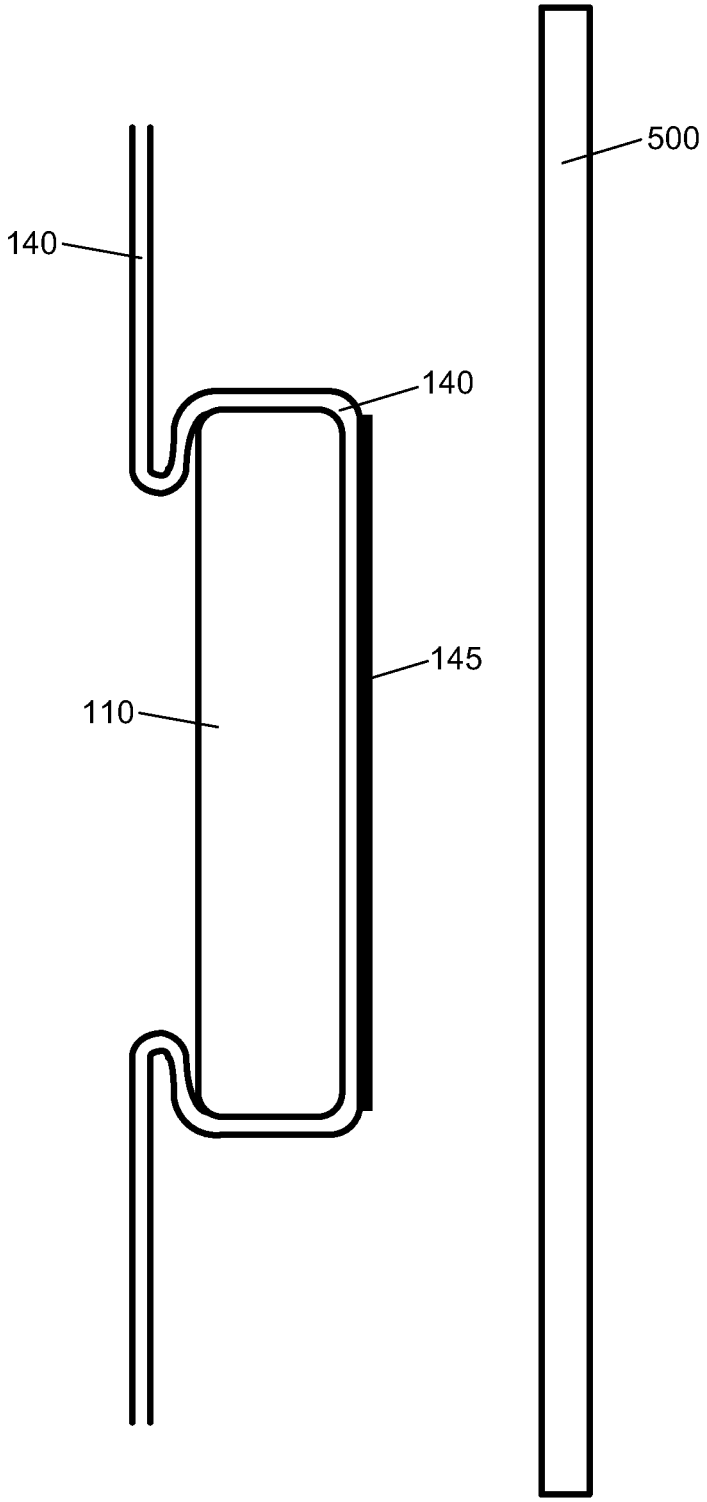
FIG. 12 illustrates a side cross-sectional view of an attachment assembly incorporated into the mounting system by vacuum forming, according to an exemplary embodiment of the present invention.

While, as described above, the attachment assemblies 110 can be secured to mounting sheet 140 by attachment members 190, this need not be the case, and other securement mechanisms may also be used instead of or along with attachment members 190. For example, FIG. 12 illustrates a side cross-sectional view of an attachment assembly 110 incorporated into a mounting system 100 by vacuum forming. Vacuum forming can be used to incorporate one or more of the upper and lower attachment assemblies 130 and 120 to their respective mounting sheets 140.

Before being formed about an attachment assembly 110, a mounting sheet 140 can be flat or substantially flat. To enable forming, the attachment assembly 110 can be placed on a stand, and the mounting sheet 140 can be placed over the attachment assembly 110 and then vacuumed. During the vacuum forming process, the mounting sheet 140 can be molded about the attachment assembly 110. As shown, when formed, the mounting sheet 140 can cover a side or portion of the attachment assembly 110 that secures to the preexisting surface 500 for mounting the display device 200. The mounting sheet 140 can also wrap around to the opposite side of the attachment assembly 110, so as to secure the attachment assembly 110 in the mounting sheet 140 and reduce dislodgment of the attachment assembly 110 from the formed mounting sheet 140.

To reduce slippage between the display device 200 and the preexisting surface 500, a friction element 145 can be positioned between the attachment assembly 110 and the preexisting surface 500 when the attachment assembly 110 is secured to the preexisting surface 500. This friction element 145 can be the mounting sheet 140 itself or a material positioned on, or covering, a portion of the mounting sheet 140 where the mounting sheet 140 covers the attachment assembly 110. In some embodiments, the friction element 145 can be a rubber or nitrile pad adhered to the mounting sheet 140 over the attachment assembly 110, or the mounting sheet 140 can provide enough friction between the attachment assembly 110 and the preexisting surface that the mounting sheet 140 itself acts as the friction element 145. The attachment assembly 110 can be configured to be releasably securable to the preexisting surface 500 even through the mounting sheet 140 and the friction element 145. For example, as discussed above, the attachment assembly 110 can comprise a magnet, which can be strong enough to attract the preexisting surface 500 through these other components.

Vacuum forming one or more mounting sheets 140 around attachment assemblies 110 can provide benefits over using attachment members 190, such as screws and the like, for securement. For example, instead of using rivets, washers, and adhesives to support securement, the mounting sheet 140 itself can be the only necessary component for maintaining securement between the attachment assembly 140 and the mounting sheet 140. Further, when the mounting sheet 140 acts as the friction element 145, yet another component (e.g., a nitrile pad or a friction-providing cover 113) can be left out of the mounting system 100. Reduced components can result in reduced costs of goods and can also facilitate easier and less costly assembly. Thus, vacuum forming can reduce overall production costs of the mounting system 100.

Accordingly, as discussed in detail above, the mounting system 100 can releasably secure the display device 200 to the preexisting surface 500, while reducing slippage or accidental removal of the display device 200 from the preexisting surface 500.

While the invention has been disclosed in exemplary forms, many modifications, additions, and deletions can be made without departing from the spirit and scope of the invention and its equivalents, as set forth in the following claims.

What is claimed is:

1. A mounting system for releasably securing a display device to a conductive surface, the mounting system comprising:

an upper mounting sheet comprising an attached portion and moveable portion, the attached portion being secured to a rear surface of the display device, and the moveable portion being moveable with respect to the rear surface of the display device, the upper mounting sheet having a horizontal joint extending across the moveable portion and having a vertical joint intersecting the horizontal joint;

at least one moveable upper magnetic assembly secured to the moveable portion of the upper mounting sheet above the horizontal joint and on a first side of the vertical joint, and variably displaceable from the rear surface of the display device via the upper mounting sheet, the moveable upper magnetic assembly being releasably securable to the conductive surface;

at least one fixed upper magnetic assembly positioned on a second side of the vertical joint and substantially fixed relative to the display device, the fixed upper magnetic assembly being releasably securable to the conductive surface; and at least one lower magnetic assembly secured to the rear surface of the display device and releasably securable to the conductive surface;

the moveable upper magnetic assembly remaining substantially flat against the conductive surface to maintain a connection between the display device and the conductive surface via the upper mounting sheet, when a portion of the display device is displaced from the conductive surface within a predetermined displacement range.

2. A mounting system for releasably securing a display device to a surface, the mounting system comprising:

a first attachment assembly on the display device for releasably securing the display device to the surface;

a connective member for attaching the first attachment assembly to the display device, the connective member comprising:

a mounting sheet extending from the display device to the first attachment assembly, an attached portion secured to the display device, and a moveable portion being moveable with respect to the display device, wherein the connective member is configured to enable the first attachment assembly to remain connected to both the display device and the surface when the display device is removed from the surface; and a second attachment assembly on the display device for releasably securing the display device to the surface.

3. The mounting system of claim 2, the connective member being configured to extend between the display device and the surface, when the second attachment assembly is released from the surface and the display device is at least partially displaced from the surface.

4. The mounting system of claim 2, the display device being displaceable by a predetermined non-zero distance or angle from the surface, while the connective member maintains a connection between the display device and the surface.

5. The mounting system of claim 2, the connective member comprising a flexible material.

6. The mounting system of claim 2, the connective member comprising a joint, enabling the first attachment assembly to remain substantially flat against the surface, when the second attachment assembly is displaced from the surface.

7. The mounting system of claim 2, the first attachment assembly comprising a friction element reducing slippage between the surface and the first attachment assembly.

8. The mounting system of claim 2, the first attachment assembly being releasably securable to a whiteboard surface.

9. The mounting system of claim 2, the first attachment assembly comprising at least one magnet.

10. The mounting system of claim 9, the first attachment assembly further comprising a friction element positioned between the at least one magnet and the surface when the first attachment assembly is secured to the surface.

11. The mounting system of claim 2, the connective member being molded about at least a portion of the first attachment assembly, wherein the connective member is positioned between the first attachment assembly and the surface when the display device is releasably secured to the surface.

12. The mounting system of claim 1, wherein at least one of the moveable upper magnetic assembly, fixed upper magnetic assembly, and lower magnetic assembly comprises an attachment assembly, the attachment assembly comprising a base including a plurality of magnets and a cover configured to cover the base and the plurality of magnets.

13. The mounting system of claim 12, wherein the cover is configured to increase friction between the attachment assembly and the conductive surface.

14. The mounting system of claim 12, wherein the plurality of magnets are distributed on an inner face of the base of the attachment assembly.

15. The mounting system of claim 12, wherein the base of the attachment assembly comprises a plurality of containers distributed on the inner face thereof, each container being configured to hold a respective one of the plurality of magnets.

16. The mounting system of claim 2, wherein at least one of the first attachment assembly and second attachment assembly comprises a base and a cover, and wherein at least one of the base and the cover defines an aperture configured to receive an attachment member.

17. The mounting system of claim 16, wherein the aperture is defined such as to receive an attachment member to secure the at least one of the first attachment assembly and second attachment assembly to the mounting sheet.

18. The mounting system of claim 16, wherein the aperture is defined such as to receive an attachment member to secure the at least one of the first attachment assembly and second attachment assembly to the display device.

19. The mounting system of claim 16, wherein the base defines a base aperture and the cover defines a cover aperture corresponding to the base aperture, wherein the base aperture and cover aperture are defined to receive the attachment member therethrough to secure the at least one of the first attachment assembly and second attachment assembly to the mounting sheet or display device.

20. A system comprising:

a display device comprising a writing surface for receiving erasable markings;

a first set of attachment assemblies attached to the display device and releasably securable to a surface;

a first mounting sheet having an attached portion and a flexible portion, the attached portion of the first mounting sheet being attached to the display device, and the flexible portion being moveable with respect to the display device, wherein the first set of attachment assemblies are attached to the flexible portion of the first mounting sheet; and a second set of attachment assemblies secured to the display device and releasably securable to the surface;

the first set of attachment assemblies configured to maintain their securement to the surface when a portion of the display device is removed from the surface.

21. The mounting system of claim 20, the first set of attachment assemblies configured to detach from the surface automatically when the display device is displaced by a predetermined distance or angle from the surface.

22. The mounting system of claim 20, the first set of attachment assemblies and the second set of attachment assemblies being configured to mount the display device on a whiteboard surface.

23. The mounting system of claim 20, the first set of attachment assemblies being configured to detach from the surface without external tools.

24. The mounting system of claim 20, the first set of attachment assemblies being magnetic.

25. The mounting system of claim 20, further comprising a spacing member connecting the second set of attachment assemblies to the display device.

26. The mounting system of claim 25, the spacing member configured to position the second set of attachment assemblies at approximately the same distance from the display device as the first set of attachment assemblies, when both the first and second sets of attachment assemblies are secured to the surface.

27. The mounting system of claim 20, the display device being useable in an electronic display system.

28. A mounting system comprising:

a mounting sheet comprising an attached portion and moveable portion, the attached portion being secured to a rear surface of a display device, and the moveable portion being moveable with respect to the rear surface of the display device;

a moveable magnetic assembly secured to the moveable portion of the mounting sheet, the moveable magnetic assembly being releasably securable to a conductive surface and variably displaceable from the rear surface of the display device via the mounting sheet; and a fixed magnetic assembly secured to the rear surface of the display device and releasably securable to the conductive surface, wherein at least one of the moveable magnetic assembly and fixed magnetic assembly comprises an attachment assembly, the attachment assembly comprising a base including a plurality of magnets and a cover configured to cover the plurality of magnets, the cover including at least one friction element, and wherein the moveable upper magnetic assembly is configured to remain substantially flat against the conductive surface to maintain a connection between the display device and the conductive surface via the mounting sheet, when a portion of the display device is displaced from the conductive surface within a predetermined displacement range.

29. The mounting system of claim 28, wherein the friction element is configured to increase friction between the attachment assembly and the conductive surface.

30. The mounting system of claim 28, wherein the plurality of magnets are distributed uniformly on an inner face of the base of the attachment assembly.

31. The mounting system of claim 30, wherein the base of the attachment assembly comprises a plurality of containers distributed on the inner face of the base, each container being configured to hold a respective one of the plurality of magnets.

* * * * *